US005552581A

United States Patent [19]

Jasper, II et al.

[11] Patent Number: 5,552,581

[45] Date of Patent: Sep. 3, 1996

[54] DEFROST HEATER FOR COOLING APPLIANCE

[75] Inventors: William C. Jasper, II, Frankfort; Cheryl S. Middleton, Argos; Ronald G. Prusinski, Plymouth, all of Ind.

[73] Assignee: Wirekraft Industries Inc., Mishawaka, Ind.

[21] Appl. No.: 337,996

[22] Filed: Nov. 10, 1994

[51] Int. Cl.[6] ..... H05B 3/06; F25D 21/06

[52] U.S. Cl. ..... 219/523; 62/276

[58] Field of Search ..... 62/150, 151, 272, 62/275, 276; 219/546, 547, 523; 165/47, 48.1, 63, 65

[56] References Cited

U.S. PATENT DOCUMENTS

| | | | |
|---|---|---|---|
| 3,359,750 | 12/1967 | Hanson | 62/276 |
| 3,394,559 | 7/1968 | Jones | 62/276 |
| 3,683,636 | 8/1972 | Tobey | 62/276 |
| 3,930,140 | 12/1975 | Pease | 219/523 |
| 4,251,720 | 2/1981 | Bleckmann | 219/541 |
| 4,369,350 | 1/1983 | Kobayashi | 62/276 |

*Primary Examiner*—Teresa J. Walberg
*Assistant Examiner*—Sam Paik
*Attorney, Agent, or Firm*—Baker & Daniels

[57] ABSTRACT

A defrost heater for a cooling appliance, such as a refrigerator or freezer, which has multiple sets of evaporator coils includes a formed glass tube enclosing an electrical resistance wire. The glass tube is substantially bell-shaped, the opposite ends of which are mounted below one set of evaporator coils. The heater includes upwardly curving portions extending upwardly in the clearance between two of the sets of evaporator coils and a downwardly facing portion connecting the upwardly extending portions of the tube which lies adjacent to the lower edge of an upper set of evaporator coils. During refrigerator defrost cycles, the electrical resistance heating wire is actuated, which heats the air in the clearance between the two lower sets of coils to defrost the lower sets of coils, and also defrosts the upper set of coils due to the fact that the uppermost portion of the bell-shaped glass tube lies above the upper level of the lower coils and adjacent the lower edge of the uppermost set of evaporator coils, thereby permitting a single defrost heater to defrost all three sets of evaporator coils.

10 Claims, 2 Drawing Sheets

DEFROST HEATER FOR COOLING APPLIANCE

BACKGROUND OF THE INVENTION

This invention relates to a defrost heater for a cooling appliance, such as a refrigerator, freezer, or other appliance having evaporating coils which require defrosting.

Cooling appliances, such as refrigerators and freezers, are provided with evaporator coils through which coolant is pumped to cool the refrigerator or freezer cooling chamber. Ambient moisture condenses and freezes on the coils, thereby requiring periodic defrosting. Modern appliances are equipped with automatic defrosting mechanisms, which include a defrost heater mounted adjacent to the coils. The defrost heaters include an electric resistive heating element which is cycled on and off periodically to heat the coils and thereby melt the moisture entrained thereon. Normally, the heating element is mounted below the coils and heat is conducted from the element to the coils by convection.

Common "side by side" refrigerator designs require multiple sets of cooling coils. Often, one set is mounted above another set, and sometimes a third set is mounted parallel to the coils of one of the other sets. Heretofore, multiple sets of coils have required multiple defrost heaters, particularly since heat is transferred by convection; accordingly, for effective cooling, the heater must be relatively close to the coils.

SUMMARY OF THE INVENTION

In the present invention, a defrost heater includes a glass tube that is bent into a complex shape so that the tube can reach hard to heat areas of the coils. It is particularly useful with multiple set which heretofore have required multiple heaters, but may also be used on single sets of coils having hard to heat areas. The shape of the tube may be bell-shaped, triangular, shaped similar to a hair pin, etc. A pair of connectors engage opposite ends of the tube, which carry conductors to connect an electrical resistance heating wire within the tube to a source of electrical energy. The bent portion of the tube extends in a plane generally parallel to the plane of one of the coils, and the tip of the bell projects above the coils and below another set of coils mounted just above the heater if the heater is used with multiple set of coils. Sometimes a third set of coils is offset on the other side of the heater, so that the glass tube in that case projects into the clearance between the sets of coils. Accordingly, a portion of the heater extends adjacent to each of the three sets of coils, where convective heating of all of the coils can take place. Accordingly, this invention has the advantage of requiring only a single defrost heater to defrost multiple sets of evaporator coils in appliances so equipped. Another important advantage of the present invention is to arrange the heater with respect to the sets of evaporator coils such that heat transfer between the heater and the coils is maximized.

BRIEF DESCRIPTION OF THE DRAWING

These and other advantages of the present invention will become apparent from the following description, with reference to the accompanying drawings, in which.

DESCRIPTION OF THE PREFERRED EMBODIMENT

Figure 1:
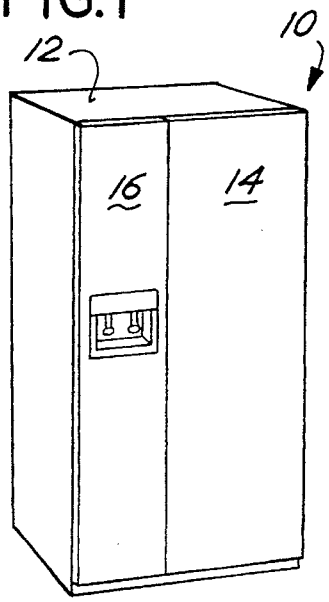
FIG. 1 is a view in perspective of a side by side refrigerator in which the defrost heater in the present invention is utilized.
Figure 2:
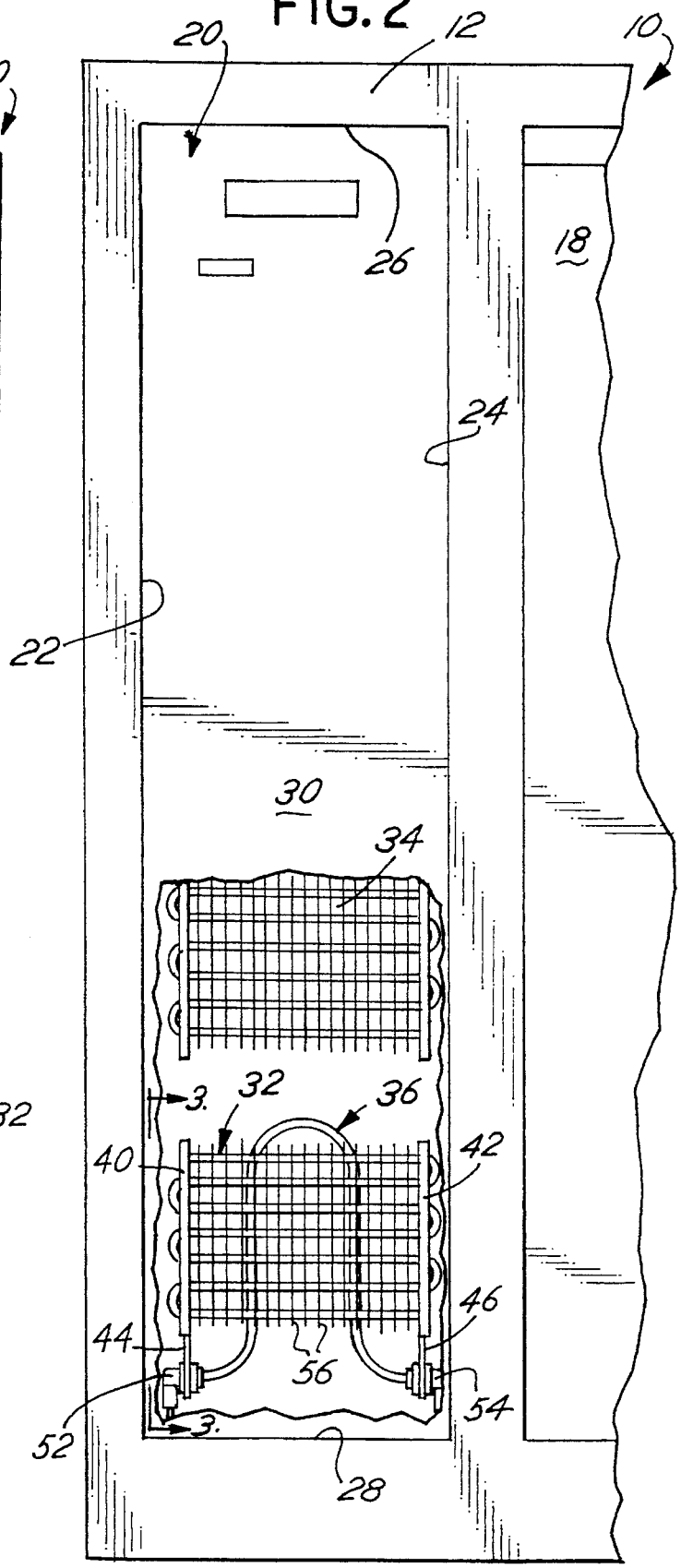
FIG. 2 is a fragmentary front plan view of the refrigerator illustrated in FIG. 1 with the doors thereof removed and a portion of the back panel of the freezing compartment broken away to reveal the evaporator coils and the glass defrost heater of the present invention.

Referring now to the drawings, a refrigerator generally indicated by the numeral 10 includes a cooling box 12 having a refrigerator door 14 and a freezer door 16. The refrigerator door 14 encloses a refrigerating compartment 18 and the freezer door 16 encloses a freezing compartment 20. As illustrated in FIG. 2, freezing compartment 20 includes an outer wall 22, an inner wall 24 that separates the freezing compartment 20 from the refrigerating compartment 18, a top wall 26, a bottom wall 28, and a rear wall 30 which is broken away in FIG. 2 to reveal a first set of evaporator coils 32, a second set of evaporator coils 34 placed above the first set of evaporator coils 32, and a glass defrost heater 36 of the present invention which extends along a plane extending alongside, and just in back of, the coils 32. A third set of coils 38 extends parallel to the coil set 32 on the other side of the defrost heater 36. Side supports 40, 42 are provided with slots receiving the ends of each of the coils of the coil set 32 for supporting them within the freezing compartment. Each of the side supports 40, 42 are provided with downward extensions 44, 46 which are provided with slots receiving a groove 48, 50 on end caps 52, 54, of a glass defrost heater 36, as will hereinafter be described. The coils of evaporator coil sets 34, 32 are supported in similar supports as side supports 40, 42 of the coil set 32. Furthermore, each of the coil sets are provided with cooling fins 56 of conventional construction.

Each of the connectors 52, 54 receive one end of a glass tube generally indicated by the numeral 58, which is supported on the extensions 44, 46 through the connectors 52, 54. Each of the conductors 52, 54 also support a conductor 60, 62 which extend through the connectors 52, 54 and connect with an electrical resistance heating wire 64. Accordingly, the opposite ends of resistance heating wire 64 are connected to an extension 66 of the conductors 60, 62 carried by the connectors 52, 54. The conductors 60, 62 complete a circuit between the electrical resistance heating wire 64 enclosed within the glass tube 58 and a source of electrical energy. The tube 58 includes a pair of upwardly curving sections 68, 70 which curve upwardly from the corresponding connector 52, 54 and blend into substantially parallel, vertical legs 72, 74. Each of the legs 72, 74 blend into a corresponding end of a downwardly curving portion 76 of the tube 68. Accordingly, the overall shape formed by the upwardly curving portions 68, 70, the legs 72, 74, and the downwardly curved portion 76 is a generally bell-shaped structure. The electrical resistance heating wire 64 extends all the way through the glass tube 58 between the conductors 60 and 62.

Figure 3:
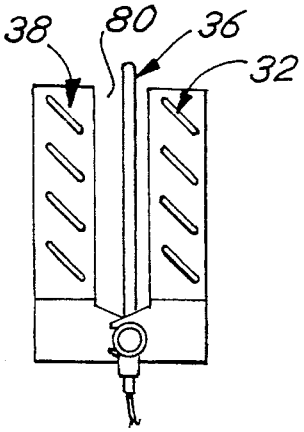
FIG. 3 is a fragmentary view taken substantially along lines 3—3 of FIG. 2, but with the fins used in evaporator coils removed.
Figure 4:
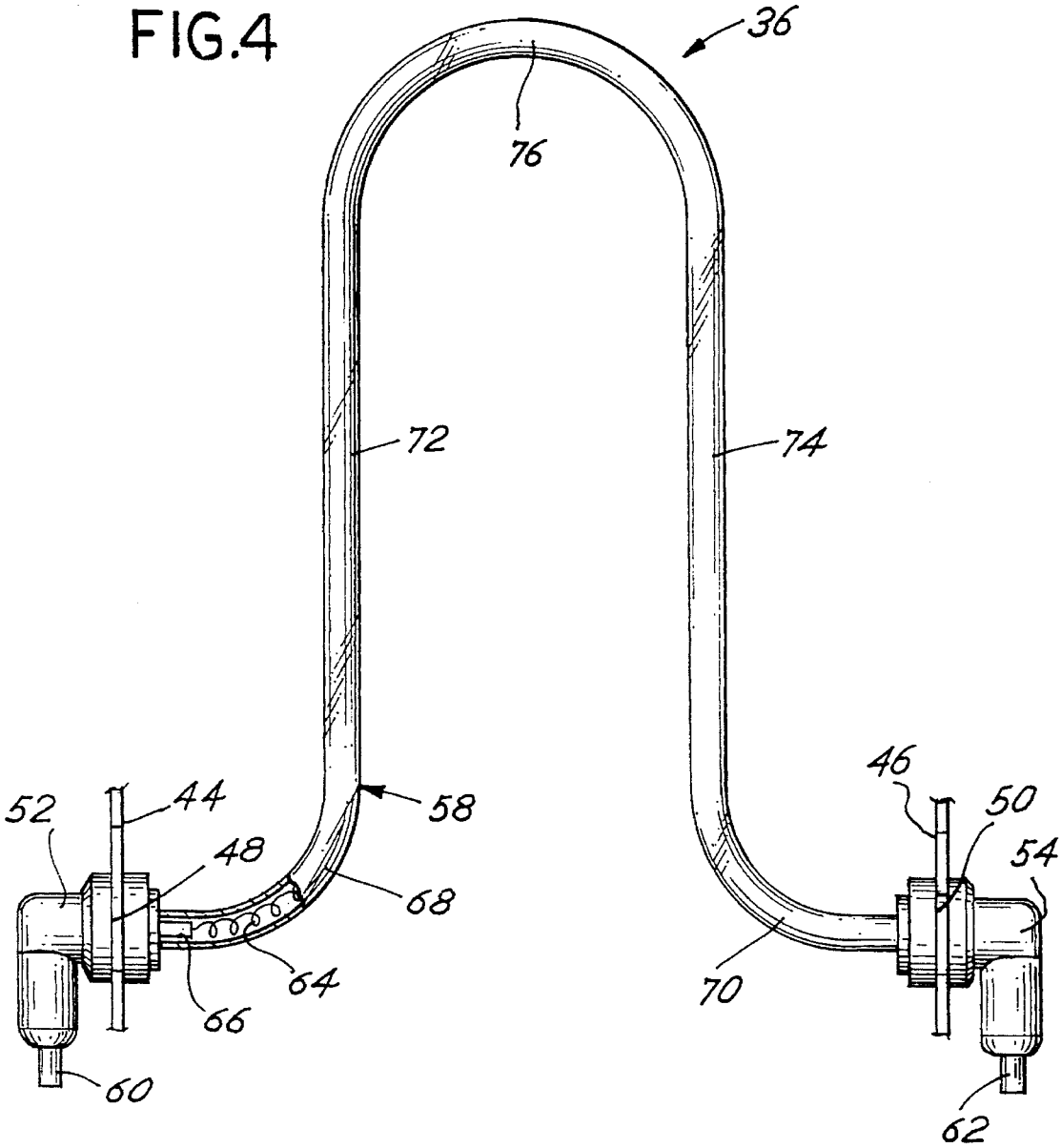
FIG. 4 is an enlarged front plan view, partly in section, of the defrost heater used in the refrigerator illustrated in FIGS. 1–3.

As shown most clearly in FIGS. 2 and 3, extensions 44, 46 support the connectors 52, 54 just below the lower edges of the set of evaporator coils 32 and the set of evaporator coils 38. The upwardly curving portions 68, 70 and the legs 72, 74 extend within the "chimney" or clearance between the evaporator coil set 32 and the evaporator coil set 38, with the downwardly curved portion 76 projecting above the upper edges of the sets of evaporator coils 32, 38 and toward the set of evaporator coils 34. Accordingly, during a defrost cycle, the coils comprising sets 32 and 38 are heated by convection by the portions of the defrost heater 36 extending below and in the clearance 80 between the sets of evaporator coils 32 and 38. The evaporator coils comprising set 34 are primarily heated (by convection) by the downwardly curving portion 76 which extends above the level of sets of evaporator coils 32, 38, although air heated by the entire glass defrost heater 36 will rise to heat the coils comprising set 34. Because the downwardly curved portion 76 extends much close to the set of evaporator coils 34 then does a conventional glass defrost heater which is mounted below the lower set of coils 32, a separate defrost heater for the set of coils 34 is not required. Accordingly, the single glass defrost heater 36 may be cycled on and off during defrost cycles to defrost all three sets of coils used in refrigerator 10.

Although the invention has been described with respect to a refrigerator having three sets of coils, the invention is applicable to cooling devices other than refrigerators and is also applicable to devices having other than three sets of coils. For example, the invention may be used with cooling devices having one, two or more set of coils with hard to heat areas.

We claim:

1. Defrost heater for a cooling appliance comprising a formed tube having opposite open ends, a heating element within said formed tube, a pair of end caps closing the open ends of said formed tube, said end caps supporting an electrical conductor connected to said heating element for supplying electrical energy thereto, supporting means for mounting the opposite ends of the tube within said appliance adjacent one set of evaporator coils, said tube having a curved portion projecting from said supporting means in a plane extending alongside said set of said evaporator coils, said supporting means mounting said end caps on a common axis, said bent portion of said tube being displaced from said axis to project in said plane along one side of said one set of evaporator coils, said tube including a pair of curved sections curved in the same direction, each of said curved sections extending from one of said end caps, and an oppositely curved section curved oppositely from the pair of section curved in the same direction, said oppositely curved section interconnecting each of said pair of curved sections to form a bell-shaped tube.

2. Defrost heater for a cooling appliance comprising a formed tube having opposite open ends, a heating element within said formed tube, a pair of end caps closing the open ends of said formed tube, said end caps supporting an electrical conductor connected to said heating element for supplying electrical energy thereto, supporting means for mounting the opposite ends of the tube within said appliance adjacent one set of evaporator coils, said tube having a curved portion projecting from said supporting means in a plane extending alongside said set of said evaporator coils, said supporting means mounting said end caps on a common axis, said bent portion of said tube being displaced from said axis to project in said plane along one side of said one set of evaporator coils, a second set of said evaporator coils extends generally parallel to said one set of evaporator coils but being displaced therefrom to define a clearance between said one and said second set of evaporator coils, said bent portion of said tube extending into said clearance.

3. Defrost heater as claimed in claim 2, wherein a third set of evaporator coils is displaced from said one set and second set of evaporator coils and extends from one side of said clearance, said bent portion of the tube extending adjacent the edge of said third set of coils nearest the one and second set of coils.

4. Defrost heater for a cooling appliance comprising a formed tube having opposite open ends, a heating element within said formed tube, a pair of end caps closing the open ends of said formed tube, said end caps supporting an electrical conductor connected to said heating element for supplying electrical energy thereto, supporting means for mounting the opposite ends of the tube within said appliance adjacent one set of evaporator coils, said tube having a curved portion projecting from said supporting means in a plane extending alongside said set of said evaporator coils, said cooling appliance having multiple sets of evaporator coils, said curved portion of said tube extending alongside one of said sets of evaporator coils and projecting toward another of said sets of evaporator coils, said sets of evaporator coils extending vertically and one set of said evaporator coils being located above another of said sets of evaporator coils, said supporting means mounting said end caps below said another set of evaporator coils, said bent portion extending toward said one set of coils and extending alongside the other set of coils.

5. Defrost heater as claimed in claim 4, wherein said tube includes upwardly curved portions extending from each of said end caps and a downwardly curving portion interconnecting the upwardly curving portions.

6. Defrost heater as claimed in claim 5, wherein said tube includes generally parallel legs interconnecting said downwardly curved portion with a corresponding one of the upwardly curved portions.

7. Defrost heater as claimed in claim 6, wherein said tube includes a pair of generally parallel legs interconnecting each of said pair of curved sections with the oppositely curved section.

8. Defrost heater for a cooling appliance comprising a formed tube having opposite open ends, a heating element Within said formed tube, a pair of end caps closing the open ends of said formed tube, said end caps supporting an electrical conductor connected to said heating element for supplying electrical energy thereto, supporting means for mounting the opposite ends of the tube within said appliance adjacent one set of evaporator coils, the plane in which said curved portion extends being substantially parallel to the plane defined by said one set of evaporator coils, the plane in which said curved portion extends being substantially parallel to the plane defined by said one set of evaporator coils, and a third set of coils extending substantially parallel to said another set of coils and offset axially with respect thereto to define a clearance therebetween, said curved portion extending in said clearance between said third set and said other set of coils.

9. Defrost heater for a cooling appliance having walls, two sets of evaporating coils carried vertically by one of said walls with one of said sets mounted above the other set, each set having coils extending from a first support supporting one end of said coils to a second support supporting the other end of said coils, said defrost heater comprising a heating element within a formed tube, a pair of end caps closing the open ends of said formed tube, said end caps supporting an electrical conductor connected to said heating element for supplying electrical energy thereto, supporting means for mounting opposite ends of the tube in a plane parallel to, but offset from, the coils of said other set, said tube having a pair of upwardly curving portions extending inwardly from each of said supports toward the other support and upwardly toward the one set of coils, and a downwardly curving portion interconnecting the upwardly curving portions.

10. Defrost heater as claimed in claim 9, wherein said cooling appliance includes a third set of evaporator coils extending parallel to, but offset from said other set of evaporator coils to define a clearance therebetween, said tube being mounted within said clearance.

* * * * *